United States Patent [19]

Lane

[11] Patent Number: 4,543,758

[45] Date of Patent: Oct. 1, 1985

[54] RAIL AND CAP STRIP FOR SECURING RUBBER ROOF MEMBRANE TO A DECK WITHOUT FASTENER PENETRATIONS

[76] Inventor: Bennie L. Lane, W-347 S-7194 Sprague Rd., Eagle, Wis. 53119

[21] Appl. No.: 582,284

[22] Filed: Feb. 22, 1984

[51] Int. Cl.[4] ..... E04B 5/00

[52] U.S. Cl. ..... 52/410; 52/96; 52/465; 52/463; 52/718.1; 160/395

[58] Field of Search ..... 52/741, 506, 202, 718, 52/717, 716, 467, 410, 465, 466, 469, 63, 222, 463; 160/392, 395

[56] References Cited

U.S. PATENT DOCUMENTS

| | | | |
|---|---|---|---|
| 419,512 | 1/1890 | Fauchaber | 52/520 |
| 1,144,265 | 6/1915 | Von Uffel | 52/462 |
| 1,484,382 | 2/1924 | Allitt | 160/395 |
| 3,453,794 | 7/1969 | Blok | 52/466 |
| 3,752,521 | 8/1973 | LaFebre | 52/716 X |
| 3,895,468 | 7/1975 | Bernstein | 52/716 X |
| 3,984,958 | 10/1976 | Murray | 52/410 |
| 4,057,095 | 11/1977 | Hirota | 160/392 |
| 4,231,141 | 11/1980 | Derrick et al. | 160/380 |
| 4,233,790 | 11/1980 | Meadows | 52/222 |
| 4,419,850 | 12/1983 | Butzen | 52/96 X |

FOREIGN PATENT DOCUMENTS

| | | | |
|---|---|---|---|
| 564239 | 2/1958 | Belgium | 52/466 |

*Primary Examiner*—J. Karl Bell
*Assistant Examiner*—Creighton Smith

[57] ABSTRACT

A method and apparatus for securing a rubber membrane to a roof, the apparatus including an elongated channel having a bite portion adapted to be secured to the surface of the roof and a pair of sidewalls extending upwardly and outwardly from the opposite edges of the bite portion. The apparatus also includes an elongated cap strip adapted to clampingly fit over the elongated channel to clamp a portion of the rubber membrane to the elongated channel without puncturing the membrane. The elongated cap strip includes a bite portion and a pair of sidewalls extending downwardly from the bite portion, the sidewalls sloping inwardly so as to converge toward one another and being adapted to snap over the upper edges of the channel sidewalls and adapted to secure the membrane against the channel and against the deck surface.

3 Claims, 5 Drawing Figures

RAIL AND CAP STRIP FOR SECURING RUBBER ROOF MEMBRANE TO A DECK WITHOUT FASTENER PENETRATIONS

FIELD OF THE INVENTION

The present invention relates to apparatus for use with rubber roof membranes and for securing them in place and more particularly to means for securing a rubber roof membrane to the surface of a deck or roof without penetrating the membrane.

BACKGROUND PRIOR ART

Recent developments in the roofing industry provide for the use of a single ply, one piece rubber membrane as a means for providing a water tight covering for a roof. The older forms of roofing used in flat roof applications employ the use of a tar, asphalt or felt roofing material. The tar-based or asphalt-based roofing materials tend to deteriorate and do not weather well. Extremes of temperature and exposure to the weather can cause cracking of the tar and leakage of the roof. Accordingly, conventional roofing methods tend to require periodic maintenance. The use of a rubber roof membrane provides a more water-tight roof which is substantially less subject to wear and which requires less maintenance. The rubber roof membranes are also relatively inexpensive to install and have achieved a substantial recognition in the building industry. In the application of a rubber roof it is important that the membrane be secured to the roof in such a manner that the possibility of penetration of the membrane be held to a minimum. Prior art methods for using a rubber membrane and for securing the membrane to the roof generally comprise the application of a layer of gravel ballast over the rubber membrane to hold it down to the surface of the roof. This is not always practical and is not an entirely satisfactory method for holding the rubber membrane in place. In many applications it is preferred to provide a positive means for mechanically securing the rubber membrane to the roof. The use of adhesive is not entirely satisfactory because adhesive is expensive and application of the adhesive to the roof is labor intensive.

Another factor to be considered in securing the rubber membrane in place is that the membrane should not be supported in a manner which might provide a gap between the membrane and its supporting surface. In order to avoid the possibility that an object will puncture the membrane, the membrane should be fully supported by a supporting surface such that the membrane can not be stretched and punctured.

Attention is also directed to the Faulhaber U.S. Pat. No. 419,512 issued Jan. 14, 1980, the Von Uffel U.S. Pat. No. 1,144,265, issued June 22, 1916 and the Blok U.S. Pat. No. 3,453,794, issued July 8, 1969. Attention is also directed to the Bernstein U.S. Pat. No. 3,895,468, issued July 22, 1975 and the Meadows U.S. Pat. No. 4,233,790, issued Nov. 18, 1980.

SUMMARY OF THE INVENTION

The present invention is directed to an improved means for securing in place a rubber membrane of the type used in roofing applications and provides a means which minimizes the possibility that the membrane will be punctured.

The present invention provides a positive mechanical means for firmly clamping the membrane in place yet clamps the membrane such that there are no points of penetration of the membrane and also such that the membrane is held securely against the supporting surface and is not permitted to pull away from the deck or other mechnical surfaces and thereby avoids the likelihood that the membrane might be punctured. The present invention also provides a means for securing a membrane in place which can be used to secure the membrane in place with a minimum of labor and expense and while providing a positive means for clamping the membrane to the surface of the roof.

Another feature of the invention is that the means provided for securing a rubber membrane to the roof can further function to clamp or secure a layer of insulation against the roof between the rubber membrane and the upper surface of the roof or deck supporting the rubber membrane.

More particularly, the invention includes an apparatus for securing a rubber roof membrane to a roof surface, the apparatus comprising a base rail adapted to be secured to the surface of the roof, the base rail including a channel having a bite portion adapted to be secured to the roof, the bite portion including opposite longitudinal edges and a pair of sidewalls extending upwardly and outwardly from the opposite edges of the bite portion. The apparatus also includes an elongated cap strip adapted to clampingly fit over the base rail to clamp a portion of a rubber membrane overlaid over the elongated base rail to the base rail without puncturing the membrane, the elongated cap strip including a bite portion adapted to be oriented generally horizontally, the bite portion including opposite elongated edges and a pair of sidewalls extending downwardly therefrom. The cap strip sidewalls slope inwardly so as to converge toward one another and include a rounded lower edge. The sidewalls are adapted to snap over the upper edges of the base rail sidewalls and are adapted to secure the membrane to the base rail.

In a preferred form of the invention the apparatus includes a rail end cap adapted to be slideably placed over an end of the elongated base rail, the rail end cap including a bite portion having opposite edges, sidewalls extending upwardly and outwardly from the bite portion and one end of the end cap including a cavity adapted to house one end of the elongated base rail.

In a preferred form of the invention the apparatus further includes a closure member adapted to clamp the portion of the rubber membrane overlying the rail end cap against the rail end cap. The closure member includes opposite ends, one end being adapted to clampingly engage the end of the rail, the other end of the end cap being inclined downwardly from the end of the rail to the deck.

The invention also includes a method for securing a rubber membrane to the surface of a deck, the method comprising the steps of securing a rail to the roof, the rail including an elongated planar bite portion adapted to be secured to the roof and a pair of sidewalls extending upwardly and outwardly from one of the opposite edges of the bite portion. The invention also includes the step of laying a rubber membrane over the deck and over the rail, with the membrane supported across the upper edges of the upwardly and outwardly sloping sidewalls of the rail, and snapping a cap strip over the portion of the membrane supported by the rail such that portions of the membrane are forced under the upper edges of the sidewalls and such that the membrane is clamped to the roof adjacent opposite sides of the rail. The cap strip includes a bite portion extending across the rail and a pair of sidewalls extending downwardly from the opposite edges of the bite portion of the cap strip and adapted to extend under the sidewalls of the rail, the cap strip sidewalls including lower edges adapted to engage the membrane to secure the membrane against the deck and beneath the rail sidewalls.

Various other features and advantages of the invention are set forth in the following description of the preferred embodiment, in the drawings, and in the claims.

Figure 3:
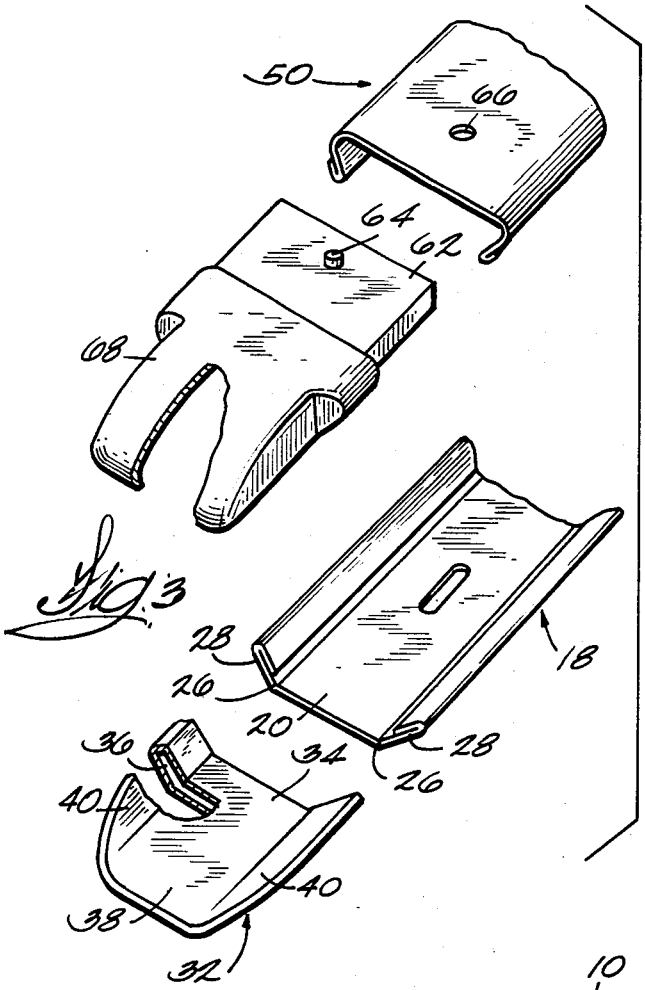
FIG. 3 is an exploded perspective view of the apparatus illustrated in FIGS. 1 and 2.
Figure 2:
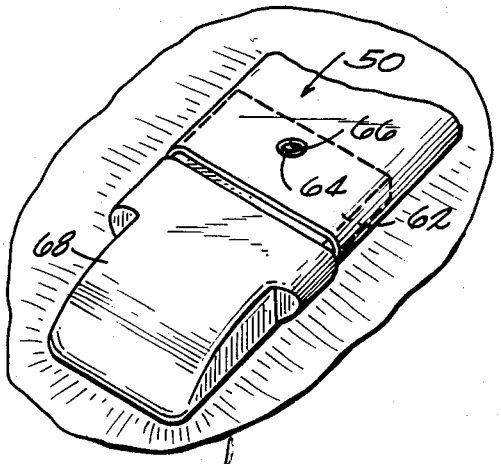
FIG. 2 is an enlarged perspective view of a portion of the apparatus illustrated in FIG. 1.

Before describing a preferred embodiment of the invention in detail, it is to be understood that the invention is not limited in its application to the details of construction nor to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Figure 1:
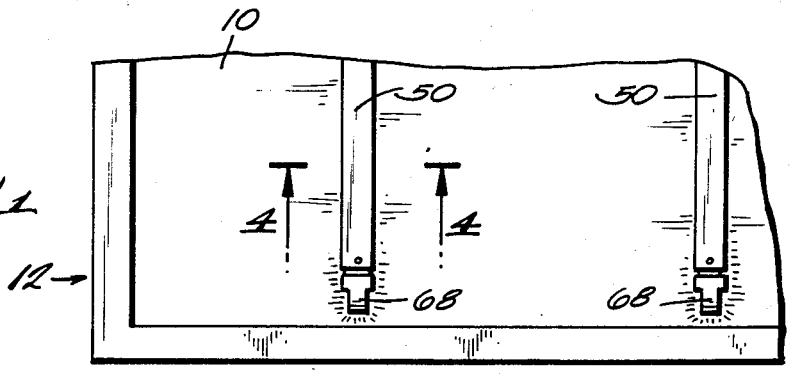
FIG. 1 is a plan view of apparatus embodying the invention securing a rubber membrane in place against the surface of a roof or deck.

Illustrated in FIG. 1 is an apparatus embodying the invention for use in securing a rubber membrane 10 to the upper horizontal surface of a deck or roof 12. An example of a suitable rubber membrane 10 for use in roofing applications is produced by the Carlisle Tire and Rubber Company, the membrane comprising a relatively thin flexible single sheet of rubber. The membrane 10 is resilient and stretchable and is sufficiently thin that it can be pierced by sharp objects if unprotected.

Also illustrated in the drawings is a layer of conventional insulating material 14 such as an expanded foam material 14, this layer of insulating material being located between the upper surface 16 of the deck and the membrane 10.

Referring now more particularly to the construction of the clamping apparatus for use in securing the rubber membrane 10 to the surface 16 of the roof, the clamping apparatus includes an elongated base rail 18. In the illustrated construction the base rail 18 comprises an elongated channel including a bite portion 20 adapted to be positioned so as to define a horizontal plane and to engage the roof, or as in the illustrated arrangement, secured to the upper surface of the insulating material 14 so as to clamp the insulating material against the surface 16 of the roof. As in the illustrated arrangement, the bite portion 20 can comprise a relatively thin planar metal member including a plurality of apertures 22 spaced along its length. Elongated screws 24 can extend through the apertures and through the insulating material 14 so as to secure the bite portion 20 in place. The bite portion 20 also includes elongated opposite edges 26, and sidewalls 28 extend upwardly and outwardly from these opposite edges 26. The sidewalls 28 are provided with rounded upper edges 30 and in the illustrated arrangement are inclined upwardly at an angle of approximately 45°. In the preferred form of the invention the bite portion 20 and the sidewalls 28 will have a one piece construction, and the curved or rounded upper edges 30 of the sidewalls 28 are formed by rolling or folding over the metal of these upper edges.

The apparatus of the structure illustrated in the drawings also includes a pair of rail endcaps 32 which are adapted to be slideably placed on the opposite ends of the elongated rail 18. The rail endcaps 32 function to provide a means for preventing the membrane 14 from being cut by sharp edges of the ends of the rail. Each rail endcap 32 includes an end 34 having a cavity 36 shaped so as to house an end of the rail 18 including the bite portion 20 and sidewalls 28 of the end of the rail. The rail endcap 32 includes a bite portion 38 and sidewalls 40 extending upwardly and outwardly away from the bite portion 38. In a preferred form of the invention, the rail endcap 32 can be conveniently formed from molded plastic. The upper edges of the sidewalls 40 of the endcap 32 are constructed so as to taper or slope from adjacent that end 34 which houses the end of the rail 18 downwardly toward the plane of the bite portion 38 such that at the opposite end of the rail endcap, the upper edges of the sidewalls 40 will merge with the bite portion 38 whereby the sidewalls of the rail endcap will form a smoothly tapered configuration.

Figure 5:
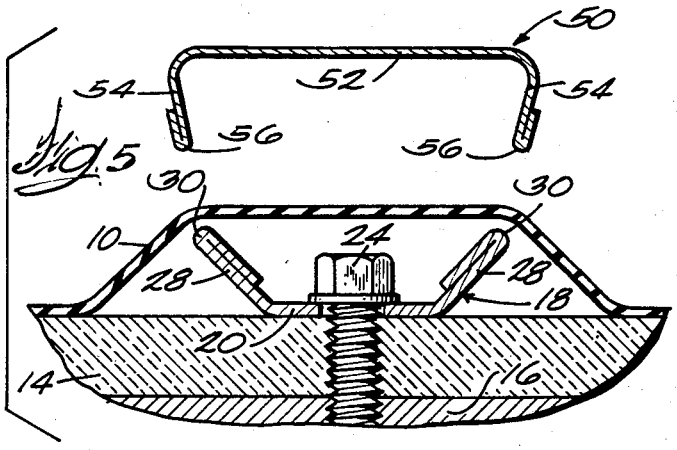
FIG. 5 is an exploded view similar to FIG. 4.

Once the base rail 18 having the rail endcaps 32 positioned on its opposite ends is secured to the upper surface of the roof or secured against the upper surface of the insulation layer 14, the rubber membrane 10 can be laid over the rail as shown in FIG. 5.

Figure 4:
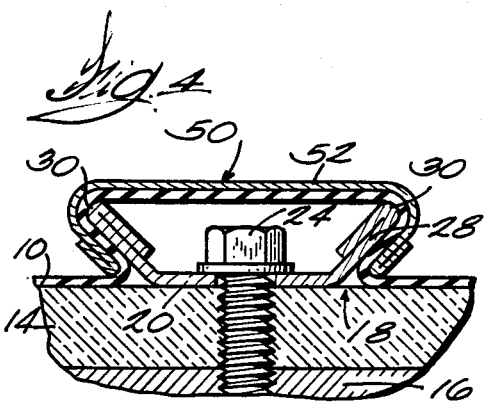
FIG. 4 is an enlarged cross-section elevation view taken along lines 4—4, in FIG. 1.

The apparatus for clamping the membrane against the roof further includes a cap strip 50 adapted to clampingly fit over the base rail 18 to clamp a portion of the rubber membrane 10 against the base rail 18 and particularly in such a manner as to avoid any possibility that the rubber membrane 10 will be punctured. More particularly, the cap strip includes an elongated bite portion 52 which is intended to overlie that portion of the membrane 10 laying on the base rail, the bite portion 52 having a width extending from the upper edge of one of the sidewalls 28 of the base rail 18 to the upper edge of the other sidewall 28 of the rail. The cap strip 50 also includes a pair of downwardly extending sidewalls 54 extending downwardly from the opposite edges of the bite portion 52 of the cap strip. The downwardly extending sidewalls 54 also slope inwardly such that the lower edges of the downwardly extending sidewalls 54 will slide under the upwardly and outwardly sloping sidewalls 28 of the base rail 18. In a preferred form of the invention the cap strip 50 will be comprised of a resilient metal, the metal being sufficiently resilient that the pair of sidewalls 54 of the cap strip can be separated so as to fit over the rubber membrane and over the upper edges 30 of the sidewalls 28 of the base rail. The cap strip 50 is then forced downwardly wherein the resiliency of the cap strip will cause the sidewalls 54 to force the membrane against the sides of the base rail sidewalls in the manner illustrated in FIG. 4. In a preferred form of the invention, the cap strip sidewalls 54 will each have a lower edge 56 positioned adjacent the surface of the roof or insulation layer so as to hold the membrane against that supporting surface in the area immediately adjacent the bite portion 20 of the rail 18. In a preferred form of the invention the lower edges 56 of the cap strip sidewalls 54 are also rounded by folding over the material of these lower edges. The rounded lower edges 56 prevent puncturing of the membrane material.

In a preferred form of the invention the apparatus will also include closure members 60 adapted to be supported on the opposite ends of the cap strip 50 and intended to clamp the rubber membrane 10 against the endcaps 32 of the rail 18. While the closure members 60 could have various constructions, in the illustrated arrangement each closure member 60 includes one end 62 which is adapted to be slideably inserted into the end of the cap strip 50. This portion 62 of the closure member 60 includes a lug 64 projecting upwardly, the lug 64 being adapted to snap into a complementary bore 66 provided in the end of the cap strip 50. The closure member 60 also includes an opposite end 68 including generally planar sidewalls having an exterior surface adapted to be contiguous with the surface of the sidewalls of the cap strip 50 and including a sloped upper surface having a first portion adapted to be contiguous with the upper surface of the bite portion of the cap strip and tapering downwardly to the surface of the membrane and complementing the curve of the sidewalls of the rail endcap. While the closure member could be comprised of various materials, in one form of the invention, the closure member is comprised of a molded plastic.

In operation of the method of the invention, the plurality of elongated rails 18 each including the endcaps 32 are secured to the roof or deck using a plurality of screws 24 spaced along the length of the rails. The rails 18 are positioned in side-by-side spaced apart relation. Once the rails have been secured in place, the rubber membrane 10 is laid over the surface of the deck and over the rails. The cap strips 50 can then be forced down over the membrane and the rails 18 so as to secure the membrane in a snap fit relation to the rails, in turn, secured to the deck. The membrane 10 is thus firmly secured by a plurality of the cap strips to the deck or roof. One of the advantages of the invention is that a mechanical means is provided for securing the membrane in place and it is not necessary to use an adhesive to secure the membrane to the surface of the deck. The mechanical securing means also provides a relatively inexpensive means for securing the membrane in place with a minimum of labor and requires little skill in its application. The apparatus also provides a means for mechanically securing the membrane in place without puncturing the membrane. It also provides a means for securing the membrane such that the membrane is protected against the possibility that it might be punctured in that the membrane is secured to the rails and to the deck and at no point is the membrane pulled away from the supporting surface or spaced from the supporting surface.

Various features of the invention are set forth in the following claims.

I claim:

1. Apparatus for securing a rubber membrane to a surface, the apparatus comprising an elongated base rail having a bite portion adapted to be secured to the surface, the bite portion including opposite longitudinal edges, and a pair of sidewalls extending upwardly and outwardly from the opposite edges of the bite portion, each of said sidewalls including a rounded upper edge, means for securing said bite portion of said elongated base rail to the surface, an elongated cap strip adapted to clampingly fit over said elongated base rail to clamp a portion of the rubber membrane overlaid over the elongated base rail to said elongated base rail without puncturing the membrane, the elongated cap strip including a bite portion adapted to be oriented generally horizontally, the bite portion including opposite elongated edges, one of said edges of said cap strip bite portion being adjacent said rounded upper edge of one of said sidewalls and the other of said edges of said cap strip bite portion being adjacent said rounded upper edge of the other of said sidewalls, and a pair of downwardly extending cap strip sidewalls, said cap strip sidewalls extending downwardly from said opposite edges of said cap strip bite portion, said cap strip sidewalls sloping inwardly so as to converge toward one another, said cap strip sidewalls each including a rounded lower edge, and said cap strip sidewalls being adapted to snap over the upper edges of said base rail sidewalls and adapted to secure said membrane against said base rail and against the surface, and a rail end cap adapted to be slideably placed over the end of said elongated base rail, said rail end cap including a bite portion having opposite edges, sidewalls extending upwardly and outwardly from said bite portion of said opposite edges, one end of said end cap including a cavity adapted to house one end of said elongated base rail.

2. An apparatus as set forth in claim 1 wherein said upper edges of said rail end cap sidewalls taper from adjacent said one end downwardly toward said rail end cap bite portion at the opposite end of said rail and cap.

3. An apparatus as set forth in claim 1 and further including a closure member adapted to clamp the portion of the rubber membrane overlying the rail end cap against the rail end cap, said closure membrane including opposite ends, one end of the closure member being adapted to clampingly engage the end of the rail, the other end of the end cap being inclined downwardly from said end of said rail to the deck.

* * * * *